United States Patent [19]

Avrea

[11] 4,079,855

[45] Mar. 21, 1978

[54] MONOLITHIC RADIATOR CAP FOR SEALED PRESSURIZED COOLING SYSTEM

[76] Inventor: Walter C. Avrea, 1405 Whalers Way, Tempe, Ariz. 85283

[21] Appl. No.: 691,769

[22] Filed: Jun. 1, 1976

Related U.S. Application Data

[63] Continuation of Ser. No. 483,564, Jun. 27, 1974, abandoned, which is a continuation-in-part of Ser. No. 193,619, Oct. 29, 1973.

[51] Int. Cl.[2] ..... B65D 51/16; F16K 17/26

[52] U.S. Cl. ..... 220/203; 220/361; 220/367; 137/493

[58] Field of Search ..... 220/203, 204, 293, 295, 220/303, 360, 361, 367, 368, 208; 137/493, 493.1, 493.2, 493.3, 493.4, 493.5, 493.6, 493.7, 493.8, 493.9

[56] References Cited

U.S. PATENT DOCUMENTS

| | | | |
|---|---|---|---|
| 3,164,288 | 1/1965 | Boomgaard | 220/203 |
| 3,381,846 | 5/1968 | Lee | 220/203 |
| 3,463,346 | 8/1969 | Mitchell | 220/203 |
| 3,831,801 | 8/1974 | Rodgers | 137/493 X |
| 3,937,357 | 2/1976 | Burgess | 220/203 |

*Primary Examiner*—George E. Lowrence
*Assistant Examiner*—Steven M. Pollard
*Attorney, Agent, or Firm*—Don J. Flickinger

[57] ABSTRACT

A monolithic radiator cap comprising a minimal number of inexpensive constituent parts engages the filler neck of an automotive cooling system. A valving gasket is normally held against the sealing surface of the filler neck by a spring which is responsive to thermal expansion of the cooling medium for controlled fluid flow out of the system. A seal is carried by the cap to engage the interior wall of the filler neck and hermetically seal the filler neck. The seal is maintained during the working and vent positions of the cap. Alternately, the cap includes auxiliary valving means for controlling fluid flow into the system in response to thermal contraction of the cooling medium.

7 Claims, 18 Drawing Figures

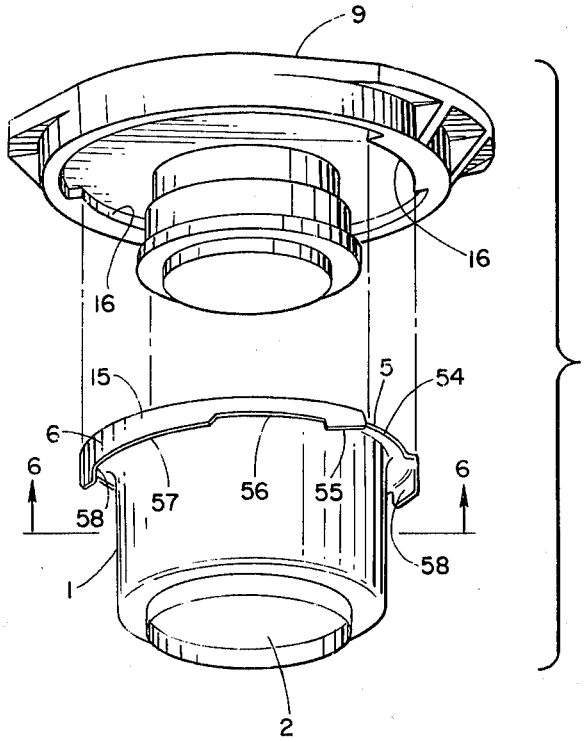
Fig. 4
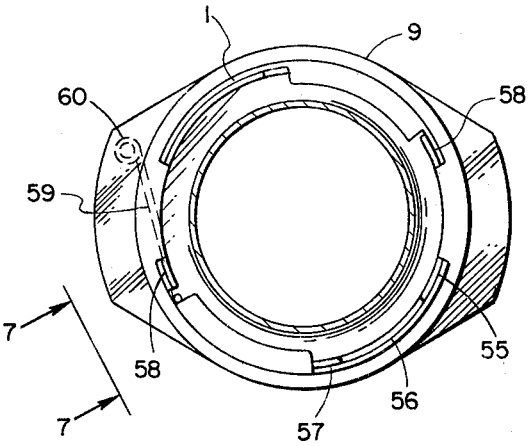
Fig. 6
Fig. 5
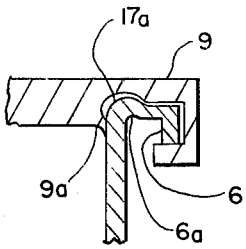
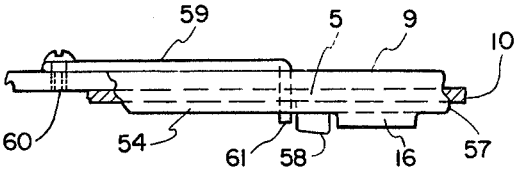
Fig. 7
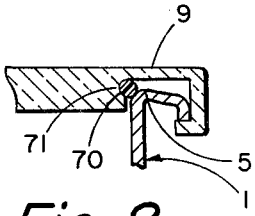
Fig. 8

MONOLITHIC RADIATOR CAP FOR SEALED PRESSURIZED COOLING SYSTEM

This is a continuation of application Ser. No. 483,564 filed June 27, 1974, which is a continuation-in-part application of U.S. application Ser. No. 193,619, filed Oct. 29, 1971, now abandoned.

This invention relates to radiator caps and more particularly to radiator caps for use in hermetically sealing pressurized engine cooling systems while valving fluid flow due to volumetric coolant variations.

Recent developments in the art of cooling internal combustion engines have culminated in a system which, during the course of normal engine operation, achieves the total expurgation of air from the cooling system and thereafter maintains the cooling system in an air-free liquid state. Such a system is described and claimed in my U.S. Pat. Nos. 3,499,481 and 3,601,181.

Previously, motor vehicle owners had been specifically instructed to fill their radiators to within a few inches of their tops so that, upon normal thermal expansion of the coolant, only the air at the top of the radiator would be forced out via the overflow passage in the radiator filler neck. By not completely filling the radiator, the loss of liquid coolant was successfully minimized but the continued presence of air within the system was made certain by design.

The deleterious effects of free oxygen (one of the principal constituents of air) on metallic and rubber parts in automative cooling systems is now well established. The air which is intentionally left at the top of the radiator becomes entrained in the liquid coolant and is thus carried throughout the cooling system. Frequently, the air forms isolated pockets within the water jacket and connecting internal passageways. Due to the presence of air within the cooling system, radiator and heater hoses oxidize, become brittle, crack and eventually burst; water pumps rapidly deteriorate as a result of being continually bombarded by streams of entrained air bubbles; and anti-freeze chemically deteriorates due to its protracted exposure to free oxygen.

Furthermore, because air is a much poorer conductor of heat than is water, the efficiency of the cooling system is decreased in proportion to the amount of air contained in and circulated through the cooling system. Thus, in the case of a cooling system which is only partially filled with liquid coolant, cooling efficiency is significantly decreased because, on one hand, the potential capacity of the system is not fully utilized and, on the other hand, the unused capacity of the system is occupied by air, which is a better heat insulator than it is a heat conductor.

Virtually all internal combustion engine cooling systems in use today are of the pressurized type. Typically, these systems are designed to operate at a pressure between twelve and eighteen pounds per square inch. During operation of the engine, heat is transferred to the circulating coolant and is carried by the coolant to the radiator for dissipation to the ambient atmosphere. As the heat content of the coolant is increased, thermal expansion (or boiling) takes place and the pressure within the cooling system eventually reaches its design value. When the design pressure is achieved, the main pressure valve in the radiator cap briefly opens to relieve the excess pressure and to allow liquid coolant, and any air which may be present, to be expelled through an overflow tube. As the engine cools, the coolant gradually loses its heat and thermally contracts; as a result, a partial vacuum is created within the system. A small vent valve opens to relieve this partial vacuum. In some instances, the vent valve opens when the pressure within the system falls to substantially atmospheric pressure; radiator caps having this feature are said to have a weighted vent valve. In other instances, the vent valve opens only after the internal pressure is below atmospheric; in which case the radiator is said to have a spring loaded, or pressure biased, vent valve.

The aforementioned United States Patents Nos. 3,499,481 and 3,601,181 set forth apparatus for effectively purging all air from internal combustion engine cooling systems. In one embodiment, a sealed radiator cap having a main pressure valve and a spring loaded vent valve, is placed in the filler neck of standard radiators. The overflow passageway from the filler neck is connected to a tube, the opposite end of which is connected to the bottom of a vented reservoir which has been partially filled with liquid coolant. During the heating cycle, and after the main pressure valve has opened, any air initially present in the system is forced through the overflow tube and bubbles up through the liquid in the vented reservoir. Expelled liquid is retained in the reservoir. When the system cools and an adequate internal vacuum is created to open the spring loaded vent valve, liquid, rather than air, is drawn back into the cooling system in an amount equal to the volume of air and liquid which was expelled during the heat cycle. After a few heating and cooling cycles, the system is entirely purged of air and remains air free in the absence of leaks or other malfunctions in the system. Furthermore, because the vent valve is normally closed, design pressure in the pure liquid system is reached in a very short time.

The radiator caps which have been used in conjunction with the cooling system just described and in conjunction with similar sealed cooling systems, utilize rivets which are placed through the center of the cap to support and retain the various valving mechanisms. This central rivet has proven to be a source of air leakage into the otherwise sealed system. When the vent valve is opened by the partial vacuum created upon thermal contraction of the coolant, air is occasionally drawn in from the ambient atmosphere through the clearance space which exists between the rivet and the material forming the cap.

In standard production cooling systems, slight air leakage around the central rivet has caused no difficulty, since the only purpose sought to be achieved by standard production systems has been to keep coolant in the system, rather than to keep air out of the system. However, in those cooling systems designed to operate in an air-free, liquid state, any air leakage around the central rivet is intolerable. Efforts to preclude air leakage by providing a closer mechanical fit between the central rivet and the corresponding hole through the cap have been frustrated due to the different coefficients of thermal expansion typically associated with the cap material and the rivet material. The sole alternative has been to seal the area around the central rivet with a caulking material.

Not only have prior art radiator caps failed to provide adequate sealing of the radiator filler neck to atmosphere, but they have also been excessively difficult and expensive to manufacture. Previously, radiator caps have been assembled from a large number of costly metallic parts. Each constituent part has required relatively expensive tooling and machinery for its production, while the assembly of the cap itself also has required expensive equipment. Furthermore, when one part of the radiator cap has failed, the user has been compelled to replace the entire cap rather than simply installing an appropriate replacement part.

Coolant systems for conventional automobiles operate at relatively high temperatures; i.e., above the usual boiling point of water. Generally, under normal conditions, the coolant liquid functions in the range of 210° F. to 260° F. without boiling. This is accomplished by judicious selection of radiator cap design and coolant mixture. The following example is illustrative.

A common coolant liquid is ethylene glycol (50%) and water (50%). This mixture increases the boiling point 14° F. above that for water. The boiling point for liquid under pressure is raised 3° F. for each 1 pound per square inch (1 psi) of pressure. A radiator cap having a design value of 15 psi will, therefore, raise the boiling point 45° F. It is seen then that the maximum operating temperature before the radiator "boils over" is 271° F.

A "cool" radiator is defined as one in which the coolant liquid is below the boiling temperature for the unpressurized specific mixture. For water, this temperature is 212° F. For the mixture in the above example, the boiling temperature is 226° F. It is common knowledge that the radiator cap should never be removed until the radiator is cool. Wholly aside from the loss of coolant liquid, there exists the potential for serious personal injury. The sudden escape of steam and superheated liquid is capable of causing severe scalding and burns. Ethylene glycol and other chemical coolants are responsible for permanent loss of eyesight and disfigurement.

In reference to the foregoing example, it is readily discernible when the temperature is above 271° F. since the radiator is boiling over. That is, the pressure within the system exceeds 15 psi or the design value of the cap. This excess pressure unseats the main pressure valve and fluid is expelled, visually and audibly, through the overflow tube. As the temperature and pressure subsides to below 271° F. and 15 psi, respectively, the main pressure valve closes erasing the readily discernible indicator of the overheated radiator condition. However, substantial risk in opening or removing the radiator cap persists until the temperature of the liquid falls below the ambient pressure boiling point or 226° F.

Statistics compiled by the Division of Labor Statistics and Research, Department of Industrial Relations, State of California, indicate that approximately fifteen percent of disabling work injuries in public and private automotive service and repair facilities result from burns and scalds due to removing radiator caps before the radiator is cooled.

Various prior art devices have been proposed which purportedly eliminate the physical hazzard associated with radiator cap removal. One such device is a radiator cap having a lever on the top thereof which is operatively associated with the main pressure valve. Lifting the lever opens the valve to permit the coolant to escape through the overflow tube until ambient pressure has been reached. The most universally accepted device is a detent arrangement which tends to retain the cap in the safe or vent position, wherein the cap is loosely engaged with the filler neck and the main pressure valve is unseated. A deliberate motion is then necessary to turn the cap to the removal position. Each device has achieved limited success in retarding the sudden and total escape of scalding liquid. However, in the latter device, steam passes between the top of the neck and the underside of the cap. Additionally, in the former device, steam is bled through the opening for the operating rod which extends between the lever and the valve. In either case, steam and superheated liquid, often containing insalutary chemicals, are discharged in the vicinity of a person's hands and face.

Accordingly, it is a principal object of the present invention to provide a radiator closure of monolithic structure for hermetically sealing standard radiator filler necks.

Another principal object of the present invention is the provision of a radiator closure as above in which the hermetic seal is maintained as long as the radiator cap is engaged with the filler neck in either the pressure relief or the working position.

Yet another object of the invention is to provide a radiator cap which will insure that the overflow from an overheated cooling system will be discharged through the overflow tube when the cap is engaged with the filler neck.

Still another object of the present invention is to provide a radiator cap which may be quickly and easily assembled from a minimal number of constituent parts.

A further object of this invention is to provide a radiator cap, the principal parts of which may be of a molded plastic material, each of which may be inexpensively mass produced.

Briefly stated, and in accordance with one embodiment of the invention, a closure and valving device is provided, which device includes: a monolithic plastic cap with a spring retention ring protruding from its lower surface; a soft annular gasket for disposition between the lower surface of the cap and the upper surface of the radiator filler neck over which the cap is secured; a circular plastic pressure pad with a spring retention ring protruding from its upper surface and a lower valving surface which cooperates with the main valve seat in the radiator filler neck to control fluid flow out of the radiator; a main pressure spring which is snappedly connected at one end to the retaining ring on the lower side of the cap and snappedly connected at its opposite end to the retaining ring on the upper surface of the pressure pad; a soft circular gasket which is snappedly positioned over a molded shoulder which is integral and concentric with an auxiliary passage through the center of the pressure pad and which protrudes from its valving surface; and, a spring loaded vent valve for controlling the flow of fluid into the radiator through the auxiliary passage.

In accordance with an alternately preferred embodiment of the invention, the main pressure spring is retained within a tubular projection depending from the undersurface of the monolithic cap. Sealing means carried by the tubular projection intermediate the cap and the main valve seat hermetically seals the cap to the filler neck, which hermetic seal remains intact during rotation of the cap when the cap is engaged over the open end of the filler neck. As used herein, "engaged" refers to the relationship of the cap to the filler neck in either the locked or vent position.

The invention is pointed out with particularity in the appended claims. However, other objects and advantages, together with the operation of the invention in its various embodiments may be beter understood by reference to the following detailed description taken in conjunction with the following illustrations wherein:

FIG. 4 is a generalized exploded view showing the interlocking relationship between a radiator cap embodying the present invention and a standard radiator filler neck;

Figure 9:
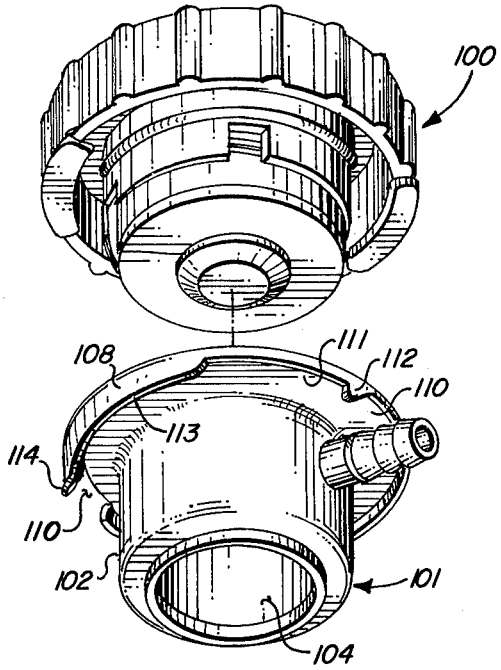
Figure 10:
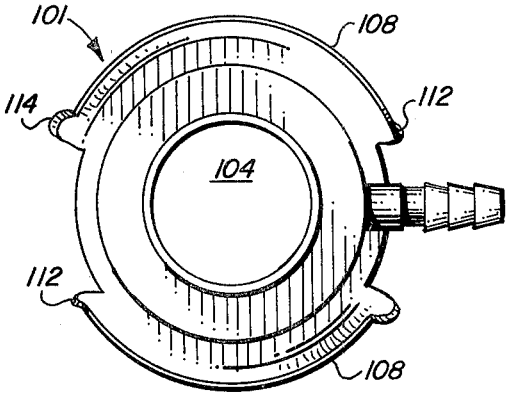
Figure 11:
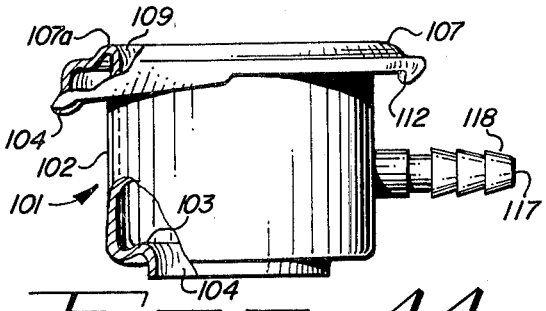
Figure 12:
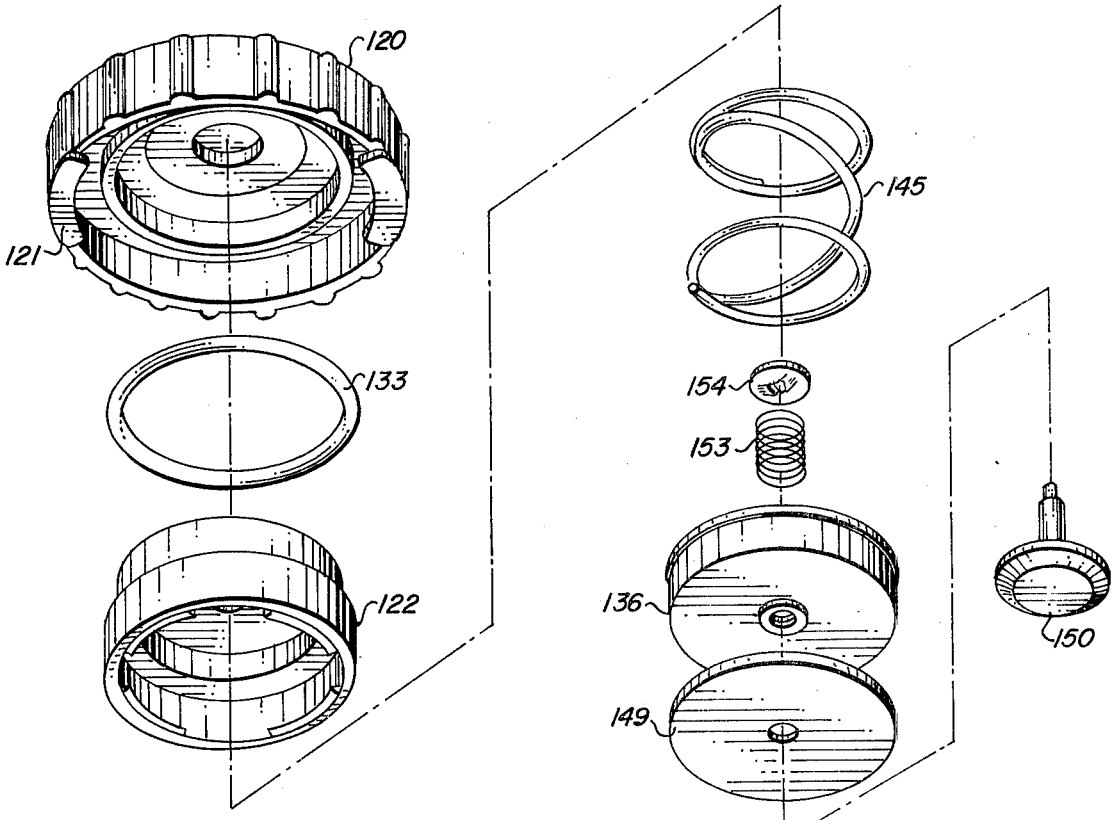
Figure 14:
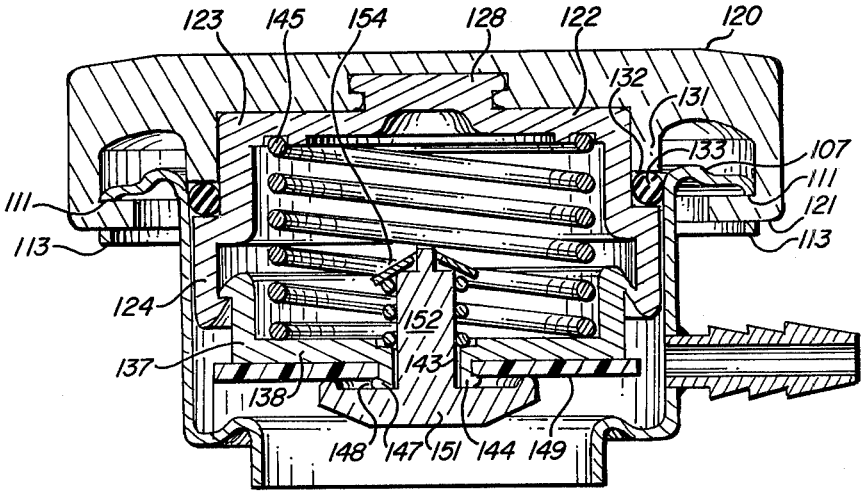
Figure 15:
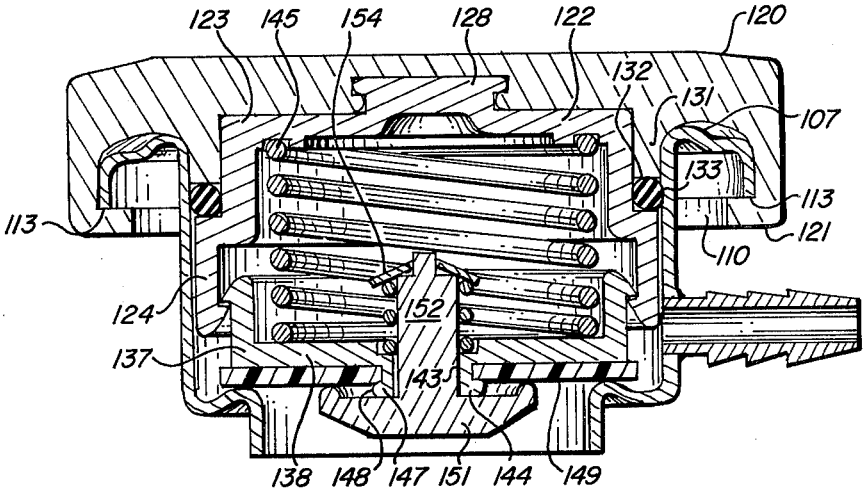
Figure 13:
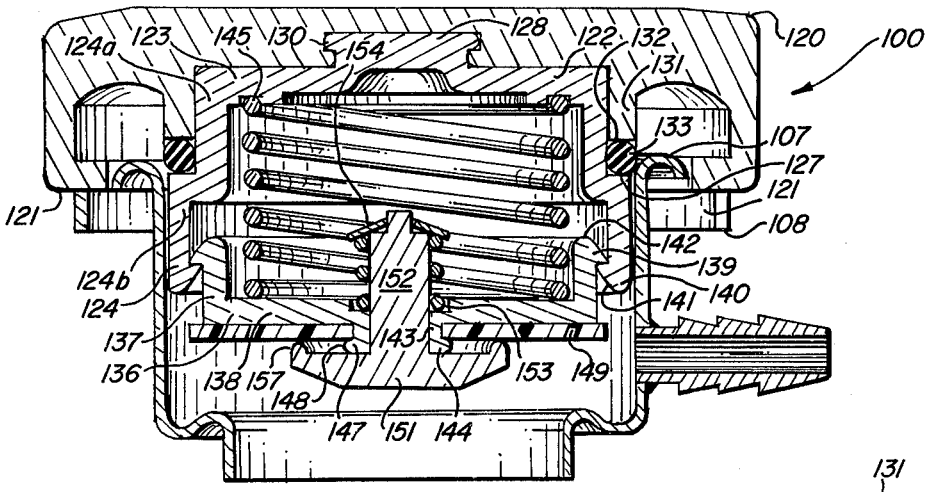
Figure 17:
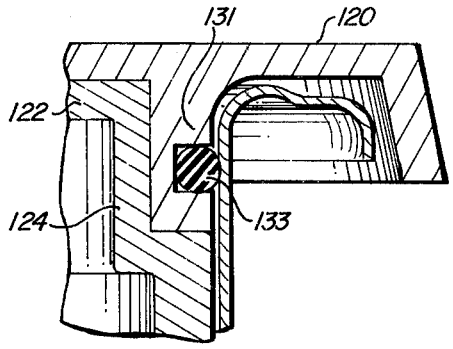
Figure 16:
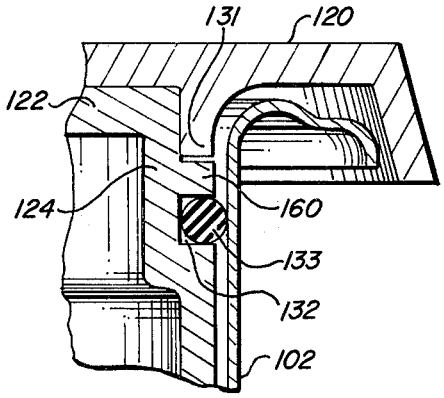
Figure 18:
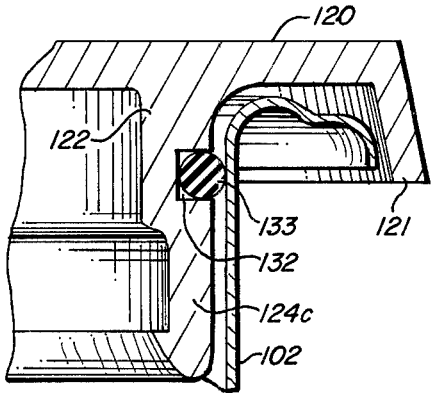
Figure 19:
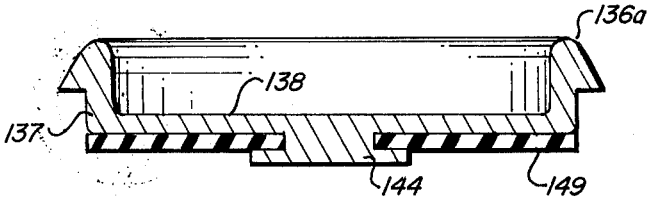

FIG. 5 of the parent U.S. patent application, Ser. No. 193,619, has been deleted. All references pertaining thereto within the specification have also been deleted. Experimentation and testing subsequent to filing the parent application have shown that the seal originally shown in FIG. 5 is not feasible with presently available manufacturing and material technology;

FIG. 6 is a view taken along section 5—5 in FIG. 4 and illustrating the relationship between the safety locking feature of the present invention and the radiator cap when disposed within a standard radiator filler neck;

FIG. 7 is a partial view taken along section 6—6 in FIG. 6 and illustrating in detail the safety locking feature of the present invention;

FIG. 8 is a partial cross-sectional view showing a further alternative arrangement for sealing the upper end of the filler neck to the ambient atmosphere;

FIG. 9 is a perspective view of a standard radiator filler neck and a preferred embodiment of a radiator closure cap for use therewith constructed in accordance with the teachings of the present invention;

FIG. 10 is an exploded perspective view of the radiator cap of FIG. 9;

FIG. 11 is a bottom view of the standard filler neck as illustrated in FIG. 9;

FIG. 12 is an elevation view, partly in section, of the filler neck illustrated in FIG. 9;

FIG. 13 is a vertical sectional view corresponding to the illustration of FIG. 9 when the radiator closure cap is initially inserted into the filler neck and is said to be in the removal position;

FIG. 14 is a vertical sectional view corresponding to the illustration of FIG. 13 at a position subsequent thereto when the cap has been rotated to the safe or vent position;

FIG. 15 is a vertical sectional view corresponding to the illustration of FIG. 14 at a position subsequent thereto when the cap has been rotated to the operating position;

FIG. 16 is a partial vertical sectional view correspondng to the illustration of FIG. 13 and specifically showing a modified arrangement of the elements thereof;

FIG. 17 is a partial vertical sectional view corresponding to the illustration of FIG. 13 and showing another modified arrangement of the elements thereof;

FIG. 18 is a fragmentary vertical sectional view corresponding to the illustration of FIG. 13 and showing yet another modified arrangement of the elements thereof; and FIG. 19 is a vertical sectional view of one of the elements as illustrated in FIG. 13, specifically detailing a modified embodiment thereof.

In order to better illustrate the advantages of the present invention and its contributions to the art, two basic embodiments and certain modifications thereof will now be described in detail.

Figure 1:
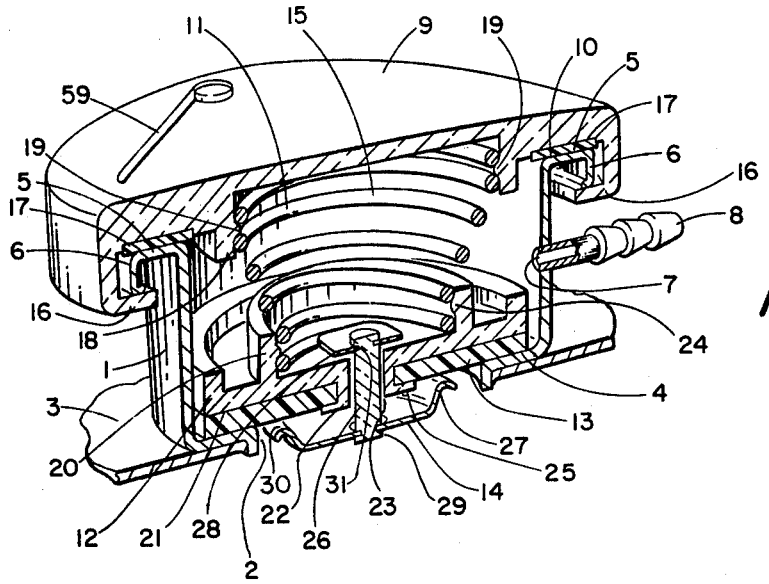
FIG. 1 is a perspective sectional view of a radiator cap disposed within a standard radiator filler neck and illustrating a first embodiment of the invention.

Referring first to the radiator cap and filler neck shown in FIG. 1, it is seen that the filler neck 1 extends upward and is concentric with a lower opening 2 in the upper surface of the radiator 3. The filler neck 1 is generally secured with solder to the upper surface of the radiator 3. The inside diameter of the filler neck is reduced to form main valve seat 4 at a point above lower opening 2. At the upper extremity of filler neck 1, the structure is formed into a circumferential sealing surface 5 and a pair of connection receiving means 6. Connection receiving means 6, better shown in FIG. 4, are of the cam and lock variety standard on most radiators manufactured in the United States.

An overflow passageway 7 extends radially by means of tubular projection 8 from a point above valving surface 4 and below sealing surface 5. In standard cooling systems, overflow passageway 7 provides fluid communication between the ambient atmosphere and the internal portion of filler neck 1. The radiator itself is connected by a lower radiator hose to a water pump which circulates coolant through compartments within the engine block and back to the radiator via an upper radiator hose. Only the upper surface 3 of the radiator is shown in the drawing. The entire cooling system, including any auxiliary heating or cooling circuits is, during normal operation, completely sealed.

The closure and valving mechanism shown in FIG. 1 consists of six basic elements: monolithic cap 9, sealing gasket 10, main pressure spring 11, pressure pad 12, valving gasket 13 and vent valve 14.

The cap 9 is of a monolithic structure, i.e., it is made of a single, generally homogeneous material. Cap 9 may be molded from an appropriate plastic, glass reinforced plastic, or an appropriate metallic material. In order to achieve hermetic sealing of the opening 15 in the upper end of filler neck 1, it is important that the portion of cap 9 disposed radially inward from the upper sealing gasket 10 be impenetrable to air. It has been found that polypropylene, ten percent glass-filled polypropylene, and polyterephthalate 6PRO, when properly molded, are suitable materials for use in the manufacture of cap 9 as well as the other principal parts of the closure and valving apparatus described and claimed herein. These plastics are manufactured by Eastman Chemical Products, Inc., under the trade name TENITE.

A pair of connection means 16 (better illustrated in FIG. 4), usually in the form of two diametrically opposite segments of an internal circumferential shoulder, cooperate with connection receiving means 6 to secure cap 9 over the opening 15 at the upper end of filler neck 1.

Sealing gasket 10 is disposed between the lower surface of cap 9 and the sealing surface 5 of filler neck 1.

Sealing gasket 10 is of a soft readily deformable material such as rubber and may be recessed into a shallow concentric channel 17. Sealing gasket 10 is preferably of the same material as valving gasket 13 and is preferably designed to have an inside diameter substantially the same, or slightly larger than, the outside diameter of valving gasket 13. Such an arrangement of inside and outside diameters allows the two gaskets to be cut from the same piece of material with a minimum amount of waste. Heretofore, the structure of radiator caps has dictated that upper sealing gaskets have inside diameters smaller than the outside diameter of any associated valving gaskets. This has resulted in the waste of the circular piece of material removed in making the annular upper gaskets.

A first retention means 18, in the form of a cylindrical ring, is integral with and projects from the lower surface of cap 9. A circumferential ridge 19 is disposed along the inner surface of first retention means 18 and serves to snappably receive and retain at least one coil at the upper end of main pressure spring 11. It will be realized by those skilled in the art that circumferential ridge 19 might be located along the outer surface of first retention means 18 and that, in such case, a larger diameter main pressure spring 11 might be snappably engaged and retained along the outer surface of first retention means 18.

Pressure pad 12, which may also be fabricated from an appropriate high temperature plastic, is characterized by four principal features: second retention means 20, valving surface 21, third retention means 22, and auxiliary passage 23 through the center of pressure pad 12. The outside diameter of pressure pad 12 is less than the inside diameter of filler neck 1 and greater than lower opening 2. Such an arrangement allows pressure pad 12 to move in an axial direction while providing positive valving action with valving surface 4.

Surface retention means 20 consists of a cylindrical ring integral with and projecting from the upper surface of pressure pad 12. A circumferential ridge 24, similar to ridge 19, is formed along the internal surface of second retention means 20 and serves to snappably receive and retain at least one coil at the lower end of main pressure spring 11.

Third retention means 22 consists of a tubular projection coaxially disposed with respect to auxiliary passage 23 and having an outwardly extending circumferential ridge 25 over which a central hole in circular valving gasket 13 is fitted, thereby securing valving gasket 13 into position against valving surface 4.

Auxiliary vent valve 14 consists of stem 26, a disc-like valve member 27 and a slightly weighted snap-on retainer 28. Valve member 27 and stem 26 may be formed into a unitary plastic structure as illustrated, for example, by the vent valve shown in FIG. 2. Alternatively, valve member 27 and stem 26 may be separate metallic elements secured together by forming lip 29 at the lower end of stem 26 after placing valving member 27 in position. In either case, an appropriate valving ridge 30 is provided to substantially reduce the effective surface area of valve member 27 coming into contact with valving gasket 13 when the auxiliary vent valve 14 is in its closed position. Valving ridge 30 also prevents valving member 27 from coming into contact with the end of third retention means 22.

The weighted retainer 28, which may be made of a suitable resilient plastic or metal material, is snapped over the upper end of stem 26 into engagement with circumferential groove 31. Weighted retainer 28 assures that auxiliary vent valve 14 is normally in a gravity biased open position.

Main pressure spring 11 may be of either the tapered variety as shown or it may be of uniform diameter. In the latter case, main pressure spring 11 would be retained by a circumferential ridge along the outer surface of second retention means 20 rather than by the internally disposed ridge 24.

Because the distance between the upper sealing surface 5 and the main valve seat 4 is standard in virtually all radiators used in automobiles manufactured in the United States, the number of turns and axial length of main pressure spring 11 may be selected so as to transfer the desired force from the lower surface of cap 9 to the upper surface of pressure pad 12 to achieve the desired design pressure required for actuation of the main valve. Such an arrangement avoids the necessity of a structural or mechanical linkage (other than the main pressure spring itself) between the cap 9 and the pressure pad 12.

Figure 2:
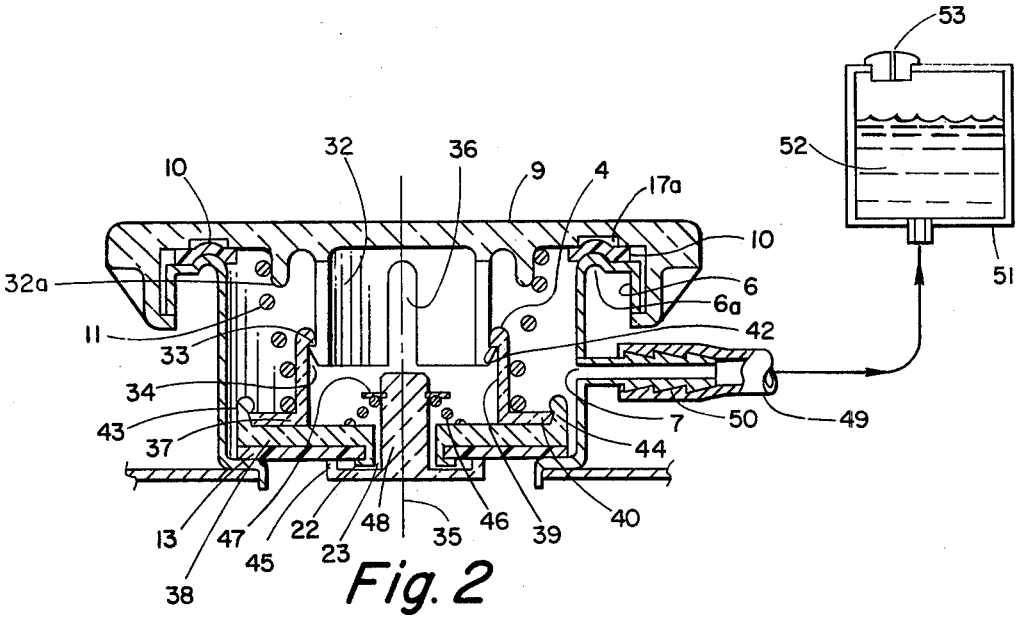
FIG. 2 is a sectional view of a radiator cap disposed with a standard radiator filler neck and illustrating a second embodiment of the invention in a preferred environment.

In those cases where a mechanical linkage between the cap 9 and the main valving structure is desired, the embodiment shown in FIG. 2 may be utilized. In FIG. 2, the first retention means 32 is an elongated cylindrical projection formed at the lower surface of cap 9 and terminating in an externally disposed circumferential shoulder 33. The external surface of first retention means 32 is tapered inwardly along beveled surface 34 from the outer extremity of shoulder 33 toward central axis 35. First retention means 32 also has elongated axial openings similar to opening 36 spaced 90° apart around its periphery. The purpose of these elongated openings is to provide limited radial flexibility to the first retention means 32 and to allow fluid communication between auxiliary opening 23 and overflow passageway 7.

In the embodiment of the invention shown in FIG. 2, the pressure pad includes two elements: second retention means 37 and pressure cup 38. Second retention means 37 consists of a tubular projection 39 which extends upwardly from and is integral with an annular base 40. The upper edge of tubular projection 39 is formed into a smooth convex surface 41 and an internally disposed circumferential shoulder 42.

The tubular projection 39 of second retention means 37 is placed inside the lower end of main pressure spring 11 and is axially moved over beveled surface 34 of the end of first retention means 32. As the curved surface 41 moves over beveled surface 42, the sides of first retention means 32 are raidally displaced to allow first retention means 37 to be snappably engaged over shoulder 33. To allow free axial movement between first retention means 32 and second retention means 37, the outside diameter of first retention means 32 and the inside diameter of tubular projection 39 are, respectively, smaller than the inside diameter of circumferential shoulder 42 and the outside diameter of circumferential shoulder 33. Thus, as pressure is exerted by the expanding fluid within the cooling system, the cylindrical pressure cup 38 transfers this pressure to annular base 40 which exerts a proportionate force on main pressure spring 11. Main pressure spring 11 contracts, allowing tubular member 39 to move upwardly over first retention means 32, thereby opening the main pressure valve. The interfering relationship of shoulders 33 and 42, accompanied by the force normally exerted by main pressure spring 11, confines the maximum axial displacement between first retention means 32 and second retention means 37.

The sides 43 of cylindrical pressure cup 38 terminate in a rouned edge forming a shallow, internally disposed shoulder 44. The inside distance between the bottom surface of pressure cup 38 and the shoulder 44 is substantially equal to the thickness of annular base 40. The outside diameter of annular base 40 is substantially equal to the inside diameter of cylindrical cup 38 at shoulder 44. The pressure cup 38 is preferably molded from a semi-rigid plastic material so that sides 43 are possessed of limited radial flexibility. The rounded edge of cylindrical pressure cup 38 is snappably engaged over the outer diameter of annular base 40 which is thereby confined within pressure cup 38.

Vent valve 45 is substantially the same as vent valve 27 in FIG. 1 except that it is pressure biased to a normally closed position by auxiliary spring 46. Spring retention clip 47 is placed over the upper end of valve stem 48 and serves to constrain spring 46.

Upper sealing gasket 10 and valving gasket 13 are substantially the same as the corresponding elements discussed in conjunction with FIG. 1. However, the upper surface of connection receiving means 6 has a convex circumferential shoulder **6*a* which is a frequent characteristic of radiator filler necks. The purpose of the convex shoulder 6*a*** is to form a well-defined sealing surface of limited cross-sectional area at the apex of the convex shoulder.

A circumferential channel **17*a* in the cap 9 is located above convex shoulder 6*a* and provides stress relief when cap 9 is tightened into position over opening 15. Circumferential channel 17*a* is narrower than sealing gasket 10 but wider than the effective diameter of convex shoulder 6*a*. When the cap 9 is secured over spring 15, the camming action of connection receiving means 6 (discussed in more detail in relation to FIG. 4) draws the cap downwardly into tight engagement with the sealing surface 5. As a result, convex shoulder 6*a* causes the slight deformation of sealing gasket 10. In its deformed state, sealing gasket 10 acts as an effective "O-ring" against the recessed surface of circumferential channel 17*a*. Such an arrangement also allows for greater variations and imperfections in the upper sealing surface 5**.

As is apparent from the configuration shown in FIG. 2, the radiator cap of the present invention may be easily assembled by hand and may be readily disassembled for the purpose of replacing constituent parts should repair be required. Assembly of the cap requires the following steps: First, the sealing gasket 10 is placed into its position along the lower surface of cap 9. Second, the main pressure spring 11 is positioned over circumferential shoulder 43 of the first retention means 32. Third, valving gasket 13 is placed in engagement with the valving surface of pressure cup 38 by being snapped over the circumferential shoulder at the end of third retention means 22. Fourth, annular base 40 of second retention means 37 is then snapped into confinement within pressure cup 38. Fifth, valve stem 48 is inserted into auxiliary passage 23, auxiliary spring 46 is placed over stem 48, and spring retention clip 47 is snapped into position. Finally, second retention means 37 is then placed inside main pressure spring 11 and snapped into slidable engagement over first retention means 32.

In their preferred embodiment, the closure and valving devices of either FIG. 1 or FIG. 2 are secured to standard radiator filler neck. The overflow passageway 7 leading from the filler neck is placed in direct fluid communication with a low point in a vented reservoir that is partially filled with liquid coolant. Such a configuration is shown in FIG. 2 where tubing 49 is placed over overflow extension 50 and generally indicated as being in fluid communication with an opening in the bottom of reservoir 51. Reservoir 51 is partially filled with liquid coolant 52 and is vented to the ambient atmosphere by means of passageway 53 through the removable filler cap.

Figure 3:
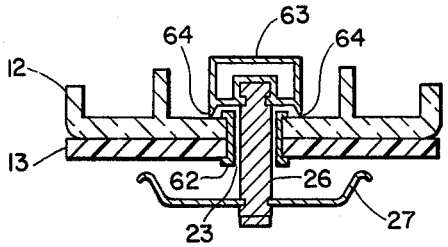
FIG. 3 is a sectional view of an alternative configuration which the vent valve may assume in either FIG. 1 or FIG. 2.

FIG. 3 shows an alternative arrangement which may be assumed by either the vent valve 14 in FIG. 1 or the vent valve 45 in FIG. 2. In FIG. 3, the pressure pad 12 is shown in a generalized configuration while the valving gasket 13 is shown to be retained in position by a metallic rivet 62 rather than by a molded shoulder such as shoulder 22 in FIGS. 1 and 2. The stem 26 and valve member 27 are retained in position with respect to auxiliary passage 23 by a lightweight plastic flotation chamber 63 which is snapped over the upper end of stem 26. Four irregular legs 64 molded at points along the bottom surface of flotation chamber 63 assure that auxiliary opening 23 will not be sealed when the auxiliary vent valve is in its maximum open position. In operation, this type of vent valve is closed whenever an adequate volume of liquid is present within that portion of filler neck 1 above the pressure pad 12.

Referring again to FIG. 4, wherein the interlocking relationship between connection means 16 of cap 9 and connection receiving means 6 of filler neck 1 is illustrated. In placing cap 9 over opening 15 of filler neck 1, connection means 16 are aligned and inserted over the cutaway areas 54 (only one is shown). The cap 9 is then forced axially downward and rotated so that connection means 16 pass over the short beveled lip 55 and into the intermediate lock position 56. Thereafter, the cap 9 is further rotated causing connection means 16 to move along the gradually beveled lip 57, the cap 9 is drawn downwardly into tight engagement with the upper sealing surface 5 of filler neck 1. As shown in FIG. 1, the tight mechanical engagement which results from this camming action causes slight deformation of sealing gasket 10, thereby achieving a positive hermetic seal between cap 9 and the filler neck 1.

FIG. 8 is a partial sectional view showing still another configuration for sealing the open end of the filler neck to the ambient atmosphere. In this arrangement, an O-ring 70 is constrained in circumferential channel 71. O-ring 70 is thus disposed between the inner surface of cap 9 and the sealing surface 5 where said sealing surface 5 curves into the inner surface of filler neck 1. It will be obvious to those skilled in the art that various arrangements may be provided for positively sealing opening 15 both with and without gaskets.

FIGS. 6 and 7 show the placement and operation of safety locking pin 59 which is secured at a point 60 beyond the outer diameter of sealing gasket 10. FIGS. 6 shows connection means 16 adjacent to stop 58 after having passed over beveled lip 57. The lower tip 61 of safety locking pin 59 rides along the upper sealing surface 5 of filler neck 1 until reaching cutaway area 54, at which time it drops by its own resilience into opposing engagement with the side of stop 58 opposite to connection means 16.

The safety locking pin 59 is normally incorporated into the cap structure only in instances where the radiator cap of the present invention is used in its preferred environment described in conjunction with FIG. 2. In the preferred environment, the absence of air in the cooling system is normally inspected by visual means as provided, for example, by a transparent sight tube inserted in the upper radiator hose leading from the engine. In such instances, safety locking pin 59 prevents the inadvertent removal of the radiator cap from the filler neck and thereby limits the possibility of losing coolant and the scalding or burning which may result from the user's exposure to hot coolant.

During experimentation with the embodiments hereinbefore described, it was discovered that a modification thereof provided vastly improved characteristics. The object of these improvements more effectively prevented steam and superheated liquid from escaping around the radiator cap when the cap was moved into the vent position on a radiator which was below boiling and above cool. An alternate embodiment of the foregoing radiator closure incorporating these discoveries will be described presently.

An alternate radiator closure, generally designated by the reference character 100 and embodying the teachings of the present invention for use with a conventional radiator filler neck, generally designated by the reference character 101, is illustrated in FIG. 9.

The general configuration of a radiator filler neck has been previously described in connection with FIG. 4. However, for a more comprehensive understanding of the radiator closure cap embodiment, as will be hereinafter described, a more detailed description of a conventional filler neck will be appreciated. In the description that follows, the configuration and dimensions associated therewith are taken from a typical radiator filler neck for the purposes of adding reality to the neck and are not meant to indicate that all filler necks are so exactly sized and shaped, nor that the embodiment of the radiator closure described thereafter is limited to the exact size and shape for the specifically described neck.

The exemplary filler neck, generally designated by the reference character 101, is shaped from 0.03 brass stock into a cylindrical section 102, the bottom of which is formed inwardly and downwardly to provide a main valve seat 103 and a lower opening 104. The main valve seat 103 includes a convex annular shoulder to form a well-defined sealing surface of limited cross-sectional area. Although not herein illustrated, the filler neck 101 is generally soldered or brazed in airtight securement to the upper surface of the radiator with the lower opening 104 in conmmunication with the interior of the radiator.

The upper end of cylindrical section 102 is shaped outwardly and downwardlly to form an upper gasket surface 107 and connection receiving means 108. The upper gasket surface 107 is approximately 0.25 inch wide and includes a convex annular shoulder **107*a* about the inlet opening 109. Between the connection receiving means 108 are two diametrically opposed cutouts 110, in which the upper gasket surface 107 is removed immediately outboard of the shoulder 107*a*. The cutouts 110 accommodate the connection means of the radiator closure, as will be hereinafter described in detail. The connection receiving means 108 includes a first downwardly directed lip 111 which is parallel to the upper gasket surface 107 and approximately 0.09 inch therebelow. The lip 111 defines the unlocked closure cap position which is variously referred to as the safe or vent position. A detent 112 is located between the lip 111 and the cutout 110. The detent 112 requires a deliberate action by the attendant to rotate the cap from the safe position to the removal position. Adjacent the safety lip 111 is a camming lip 113 which begins approximately 0.06 inch below the lip 111 and is gradually directed downward therefrom to fall approximately 0.06 inch throughout its length, terminating with a stop 114 at the end thereof. The lip 113 cams the closure cap into the locked position, which is alternately referred to as the working or operating position. An overflow passage 117 extends radially by means of tubular projection 118 from a point above main valve seat 103 and below upper gasket surface 107. In standard cooling systems, a flexible tube or hose is attached at one end thereof to the tubular projection 118** with the other end thereof below the radiator, whereby overflow including steam and superheated liquid is discharged from the radiator to the atmosphere at a point remote from the hands and face of one attempting to open the radiator.

The alternate embodiment 100 of the radiator closure of the present invention is best described in connection with FIGS. 12 and 13, which show the device having a cap 120. A pair of connection means 121 in the form of two diametrically opposed segments of an internal circumferential shoulder cooperate with the connection receiving means 108 to secure cap 120 over the opening 109 at the upper end of the filler neck 101. A further explanation of the interaction between the connection means 121 and the connection receiving means 108 and the resultant effect upon the closure structure 100 will be presented presently.

First retention means 122 is in the general configuration of an inverted cup having a cylindrical pressure plate 123 from which depends tubular projection 124. Tubular projection 124 has a first cylindrical section **124*a* and a second cylindrical section 124*b* of larger diameter to form an annular shoulder 127 therebetween. A cylindrical projection 128, having an annular ridge 129 at the upper end thereof, extends upwardly from pressure plate 123 and is snappably received within the groove 130 on the undersurface of cap 120. The cap 120, the first retention means 122 and the projection 128 are in axial alignment with the ridge 129 rotatably received within the groove 130. First retention means 122 is thereby secured to, but independently rotatable, with cap 120. Tubular projection 131, depending from the undersurface of cap 120, closely but pivotally encircles a portion of first cylindrical section 124 and terminates at the lower end thereof in spaced relationship to annular shoulder 127 to form annular groove 132 in which resides O-ring 133**.

Second retention means 136 consists of a cylindrical ring 137 integral with and projecting from the upper surface of pressure pad 138. Outwardly directed annular shoulder 139 proximate the top of circumferential ring 137 engages over the inwardly directed shoulder 140 proximate the lower end of tubular projection 124. To assist in snappably engaging the first retention means 122 with the second retention means 136 during assembly, the lower edge of tubular projection 124 is tapered outwardly downward along beveled surface 141 from an apex with shoulder 140, while circumferential ring 137 is tapered inwardly upward along beveled surface 142 from an apex with shoulder 139. Main spring 145 is retined within first retention means 122 and second retention means 136 with the upper end thereof bearing against pressure plate 123 and the lower end thereof bearing against pressure pad 138.

A cylindrical passage 143 extends coaxially through pressure pad 138. Third retention means 144 consists of a tubular projection 147 coaxially disposed with respect to passage 143 and having an outwardly extending circumferential ridge 148 over which a central hull and circular valving gasket 149 is fitted.

Auxiliary vent valve 150 includes a disc-like valve member 151 and a stem 152 extending upwardly therefrom through the passage 143. Auxiliary spring 153 encircling stem 152 bearing against the pressure pad 138 at the lower end thereof and against snap clip 154 which is secured to the upper end of stem 152 retains the auxiliary vent valve 150 in the normally closed position. Valving ridge 157 extending upwardly from valve member 151 substantially reduces the effective valve area coming into contact with valving gasket 149 when the auxiliary valve is in the closed position. Ridge 157 also prevents valving member 151 from coming into contact with the end of third retention means 144.

As specifically seen in FIG. 13, the radiator closure or cap assembly 100 is in the initial stage of attachment to filler neck 101. Connection means 121 are received within cutouts 110 prior to contacting connection receiving means 108. No engagement has been effected between O-ring 133 and gasket 149 as carried by radiator closure 100 and the respective sealing surfaces of filler neck 101.

Subsequently, as viewed in FIG. 14, radiator closure 100 has been urged downwardly and cap 120 has been rotated in a clockwise direction, thereby urging engagement means 121 past detents 112 to engagement under safety lips 111. At this intermediate stage, variously referred to as the "safe" or "vent" position, the radiator closure is said to be unlocked. In accordance with conventional practice, gasket 149 is spaced above main valve seat 103 to provide communication between the interior of the radiator and overflow passage 117. During this time, coolant liquid which is below the boil-over temperature and yet above the cool temperature, as hereinbefore described, escapes through the overflow passage 117.

In direct contrast, however, to prior art devices, an hermetic seal is maintained between the filler neck and the radiator closure since O-ring 133 is maintained in selaing engagement with the interior wall of cylindrical section 102. This prevents the escape of steam and superheated liquid from around the radiator cap and the attendant potential for personal injury.

Further rotation of cap 120, as specifically illustrated in FIG. 15, brings connection means 121 under camming lip 113, during which action radiator closure assembly 100 is forced downwardly by continued rotation until connection means 121 abut stops 114. The radiator closure is now in the normal or working condition with valving gasket 149 held in sealing engagement against main valve seat 103 by main spring 145. As will readily be understood by those skilled in the art, excessive pressure within the radiator overcomes main spring 145, forcing second retention means 136 upwardly, unseating gasket 139 from main valve seat 103 for the discharge of radiator coolant liquid through opening 104 to overflow passage 117. Subsequently, as the radiator cools and a vacuum is formed therein, vent valve 151 is drawn downwardly to open against auxiliary spring 151, either for the induction of air or coolant liquid into the radiator.

An additional advantage of the foregoing embodiment of the invention, as specifically described in FIGS. 13–15, is gained from the fact first retention means 122 is pivotally connected to cap 120. As particularly noted herein, as the connection means 121 are moved from the cutout 110 along the safety lip 111 and the camming lip 113 to the stop 114, only the cap 120 is forced to rotate while the other components of the device are displaced axially along the filler neck. During the axial movement in a typical case, O-ring 133 is displaced approximately ⅛ inch along the interior wall of cylindrical section 102, while gasket 149 is simply brought to bear against main valve seat 103. The working life of the resilient sealing means is therefore extended since neither seal is abrated by continuous or excessive movement against any possible surface roughness on the respective sealing surface.

FIG. 16 illustrates an alternately preferred embodiment of the invention, in which an annular collar 160 is carried by tubular projection 124 immediately above O-ring groove 132 to provide the upper horizontal surface thereof. The instant embodiment prevents the rotation of cap 120 against the upper surface of O-ring 133 but is otherwise functionally equivalent to the embodiment of FIG. 13.

FIGS. 17 and 18 illustrate alternate embodiments of the present invention in which O-ring 133 is rotatable with cap 120. As illustrated in FIG. 17, tubular projection 131 is extended to include O-ring groove 132. In the embodiment of FIG. 18, tubular projection 131 and tubular projection 124 are formed integrally as tubular projection **124*c* with cap 120. As a result, first retention means 122** is also integrally formed therewith.

FIG. 19 illustrates an alternately preferred second retention means **136*a* which differs from the previously described second retention means 136 only in that the pressure pad 138 is continuous. That is, vent valve 151 and passage 143 therefore have been eliminated. Alternately preferred second retention means 136*a* adapts the radiator closure 100** for use with radiators having integral vent valving.

In the foregoing embodiment particularly described in connection with FIGS. 12–18, it will be appreciated that tubular projection 131 depending from cap 120 and tubular projection 124 integral with first retention means 122 are cool functioning subelements of a senior tubular projection, one of the primary purposes of which is to support the first sealing means specifically illustrated as O-ring 133. This concept is further clarified with reference to FIG. 18, in which tubular projection 131 and tubular projection 124 have no separate identity within tubular projection **124*c*. Additionally, various seals of diverse configurations are well known within the art as a substitute for O-ring 133**.

It will be apparent to those skilled in the art that a large number of variations may be incorporated into the various embodiments of the invention disclosed herein. By way of example, the various constituent parts may be molded from materials other than plastics; the cap may be molded from plastic while the pressure pad and its associated parts may be stamped from an appropriate metallic material; various techniques may be used for retaining the ends of main spring in engagement with the cap or the pressure pad; a variety of structures may be utilized for retaining the valving gasket in alignment with the auxiliary opening; the cap may be given monolithic characteristics by sealing, reinforcing, or encapsulating otherwise non-monolithic cap structures; the main seal between the cap and the opening may be achieved through a plurality of mechanisms, or, equivalent structures may be used to snappably engage second retention means into a constrained slidable relation with first retention means.

Having fully described and disclosed the present invention and the preferred embodiments thereof in such clear and concise terms as to enable those skilled in the art to understand and practice the same, the invention claimed is:

1. In a radiator cap for closing the filler neck of an engine cooling radiator, said filler neck having:

an upper open end, a main valve seat formed in the lower portion thereof, and a vent opening intermediate said upper end and said main valve seat, said radiator cap including:

a cover member for the upper end of said filler neck, a valve movably supported on said cover member, means extending between said cover member and said valve for urging said valve into sealing engagement with said main valve seat, and means associated with said cover member and engageable with said filler neck for selectively maintaining said radiator cap in at least two operative positions, a sealed position in which said cover member and valve movably supported thereon are in a lowered sealed position, with said valve seated against said main valve seat, and a vent position in which said cover member and valve movably supported thereon are in a raised vent position with said valve spaced upwardly away from said main valve seat, the improvements in said radiator cap comprising:

(a) sealing means adapted to be operatively sealingly engaged and positioned between said radiator cap and the inner surface of said filler neck, intermediate the upper end thereof and said vent opening, and (b) means for radially continuously supporting said sealing means to maintain said sealing engagement between said radiator cap and the inner surface of said filler neck when said cap is in either of said operative positions, said sealing means, said supporting means and said cover member cooperating to insure that substantially all fluids passing through said valve seat also pass through the vent opening of said radiator neck, and to seal said filler neck against the entry of air through the open end thereof.

2. Improved radiator cap of claim 1, in which the means for radially continuously supporting said sealing means is rotatably engaged with said cover member to permit relative rotational movement of said cover member and said sealing means, thereby permitting said cover member to be rotated to either of said operative positions without substantial rotational movement of said sealing means relative to said filler neck.

3. Improved radiator cap of claim 1, in which said sealing means is an O-ring and in which said means for radially continuously supporting said sealing means is a tubular projection rotatably connected to and depending from said cover member and having an O-ring supporting groove formed in the periphery thereof to radially continuously support said O-ring in sealing engagement with the inner surface of said filler neck.

4. In a radiator cap for closing the filler neck of an engine cooling radiator, said filler neck having:

an upper open end, a main valve seat formed in the lower portion thereof, and a vent opening intermediate said upper end and said main valve seat, said radiator cap including:

a cover member for the upper end of said filler neck, a valve movably supported on said cover member, spring means extending between said cover member and said valve for urging said valve into sealing engagement with said main valve seat, and means associated with said cover member and engageable with said filler neck for selectively maintaining said radiator cap in at least two operative positions, a sealed position in which said valve is seated against said main valve seat, and a vent position in which said valve is spaced away from said main valve seat;

the improvements in said radiator cap comprising:

(a) sealing means engaging said filler neck proximate the open end thereof, and (b) means for radially continuously supporting said sealing means to maintain a sealing engagement between said filler neck when said cap is in either of said operative positions, said supporting means being rotatably engaged with said cover member to permit relative rotational movement of said cover member and said sealing means, thereby permitting said cover to be rotated to either of said operative positions without substantial rotational movement of said sealing means relative to said filler neck;

said sealing means, said supporting means and said cover member cooperating to insure that substantially all fluids passing through said valve seat also pass through the vent opening of said radiator neck, and to seal said filler neck against the entry of air through the open end thereof.

5. Improved radiator cap of claim 4, in which said sealing means is an O-ring and in which said means for radially continuously supporting said sealing means is a tubular projection depending from said cover member and having an O-ring supporting groove formed in the periphery thereof to radially continuously support said O-ring in sealing engagement with the inner surface of said filler neck.

6. In a radiator cap for closing the filler neck of an engine cooling radiator, said filler neck having:

an upper open end, a main valve seat formed in the lower portion thereof, and a vent opening intermediate said upper end and said main valve seat, said radiator cap including:

a cover member for the upper end of said filler neck, a valve movably supported on said cover member, spring means extending between said cover member and said valve for urging said valve into sealing engagement with said main valve seat, and means associated with said cover member and engageable with said filler neck for selectively maintaining said radiator cap in at least two operative positions, a sealed position in which said valve is seated against said main valve seat, and a vent position in which said valve is spaced away from said main valve seat, the improvements in said radiator cap comprising:

(a) a tubular sleeve extending downwardly from said cap member and which sleeve is radially proximately spaced from the filler neck when said cap is mounted thereon, (b) an annular groove formed in the exterior of said sleeve intermediate the upper and lower ends thereof, (c) sealing means disposed within said groove and maintained in sealing engagement with said filler neck when said cap is in either of said operative positions, (d) the lower end of said sleeve including an integral laterally extending flange, (e) said valve including a laterally extending flange adapted to be snapped over said sleeve flange to movably retain said valve to said sleeve, (f) said spring means being entirely disposed within said sleeve and biasing the valve flange against said sleeve flange, said sealing means, said supporting means and said cover member cooperating to insure that substantially all fluids passing through said valve seat also pass through the vent opening of said radiator neck, and to seal said filler neck against the entry of air through the open end thereof.

7. Improved radiator cap of claim 6 in which the cover member includes an annular flanged recess, the upper end of said tubular sleeve including an annular lip adapted to snap within said annular flanged recess to rotatably connect the tubular sleeve to said cover member.

* * * * *